US007220459B2

(12) United States Patent
Trevisan

(10) Patent No.: US 7,220,459 B2
(45) Date of Patent: May 22, 2007

(54) METHOD FOR FINISHING A MANUFACTURED ARTICLE BY POWDER PAINTING

(75) Inventor: Tito Trevisan, Verona (IT)

(73) Assignee: Paradigma S.R.L., Verona (IT)

( * ) Notice: Subject to any disclaimer, the term of this patent is extended or adjusted under 35 U.S.C. 154(b) by 0 days.

(21) Appl. No.: 10/343,630

(22) PCT Filed: Aug. 2, 2001

(86) PCT No.: PCT/EP01/08946

§ 371 (c)(1),
(2), (4) Date: Feb. 3, 2003

(87) PCT Pub. No.: WO02/11893

PCT Pub. Date: Feb. 14, 2002

(65) Prior Publication Data

US 2003/0175417 A1 Sep. 18, 2003

(30) Foreign Application Priority Data

Aug. 10, 2000 (IT) ..... VR2000A0078

(51) Int. Cl.
*B05D 1/06* (2006.01)
*B05B 5/025* (2006.01)

(52) U.S. Cl. ..... 427/466; 427/458; 427/468; 427/469; 118/624; 118/625

(58) Field of Classification Search ..... 427/466, 427/458, 468, 469; 118/624, 625
See application file for complete search history.

(56) References Cited

U.S. PATENT DOCUMENTS 1,784,912 A * 12/1930 Scott ..... 101/129
3,238,053 A * 3/1966 Morgan ..... 430/97
3,295,440 A 1/1967 Kennedy et al.
3,340,802 A 9/1967 Pilon (Continued)

FOREIGN PATENT DOCUMENTS

EP A-0 297 520 1/1989

(Continued)

OTHER PUBLICATIONS

Powder Coating: The Complete Finisher's Handbook, N. P. Liberto (ed) pp. 82-83, 1994.*

(Continued)

*Primary Examiner*—Fred J. Parker
(74) *Attorney, Agent, or Firm*—Modiano & Associati; Albert Josif; Daniel O'Byrne

(57) ABSTRACT

A method for finishing a manufactured article by powder painting, comprising the step of applying, on a surface to be decorated of the manufactured article, one decorative layer obtained by means of the transfer by controlled migration of powder particles which originate from a graphic matrix arranged in front of the surface to be decorated and designed to adhere thereto; the transfer and adhesion steps being provided by a first electostatic field which comprises lines of force incident at right angles to the surface to be decorated, the manufactured article acting fully or partly as reference electrode for the first electrostatic field, so as to produce a condition of solid contact between the electrode and the surface to be decorated.

19 Claims, 5 Drawing Sheets

U.S. PATENT DOCUMENTS

| | | | | |
|---|---|---|---|---|
| 3,340,803 | A | | 9/1967 | Childress et al. |
| 3,342,621 | A | * | 9/1967 | Guy et al. ..... 427/475 |
| 3,521,558 | A | * | 7/1970 | Fisher et al. |
| RE28,068 | E | * | 7/1974 | Lemelson |
| 3,828,670 | A | | 8/1974 | Kennedy |
| 4,180,844 | A | * | 12/1979 | Peck |
| 5,834,067 | A | * | 11/1998 | Rodely |

FOREIGN PATENT DOCUMENTS

| | | | |
|---|---|---|---|
| EP | A-0 412 289 | | 2/1991 |
| FR | A-2 210 149 | | 7/1974 |
| JP | 2005-254698 | * | 9/2005 |
| WO | A-97 05965 | | 2/1997 |

OTHER PUBLICATIONS

Patent Abstracts of Japan vol. 008, No. 104 (M-296), May 16, 1984 & JP 59 016771 A (Origin Denki KK), Jan. 27, 1984.

* cited by examiner

METHOD FOR FINISHING A MANUFACTURED ARTICLE BY POWDER PAINTING

BACKGROUND OF THE INVENTION

The present invention relates to a method for finishing a manufactured article by powder painting.

Finishing by powder painting is currently widely used in decorating, so as to imitate the grain of a type of wood, metallic profiled elements to be used in particular for door and window parts.

The metallic profiled elements, after being adequately prepared for painting, are subjected to a treatment cycle which provides for the following operating steps: first of all, a first layer of powder paint or primer is deposited on the profiled element; then partial polymerization of the first layer of paint is provided; then a second layer of powder paint, having a different color or shade than the underlying layer, is applied according to a preset graphic configuration; and, final baking is performed to fully polymerize the first and second layers of paint.

The above described painting process, however, has drawbacks which drastically limit the industrial applicability thereof, both in terms of mass-production and of final cost of the finished product. The most critical step of such a treatment cycle is the application of the second layer of paint, i.e., the decorative layer, and this task is often entrusted to the experience and skill of qualified personnel capable of reproducing a particular graphic configuration, such for example an imitation grain, on any metallic or non-metallic substrate, by working manually with the aid of traditional tools such as for example brushes and paint-brushes.

From the above description it is easy to understand that it is not possible to provide an industrial process that includes an operation entirely performed by hand, since this operation constitutes an inevitable and economically unsustainable bottleneck which results in severely slowing the entire production cycle.

Through attempts to convert the process for finishing manufactured articles from a strictly manual to an automated treatment resulted in improvement the speed of the production cycle, they have not been qualitatively successful in terms of resemblance to the original, thus requiring continuous manual intervention by specialized personnel downstream of the treatment cycle.

Examples of powder painting devices are available from the Patent Abstracts of Japan, vol. 008 no. 104 and JP-A-016771 and from U.S. Pat. No. 3,295,440.

SUMMARY OF THE INVENTION

The aim of the present invention is to provide a method for finishing manufactured articles by powder painting which is capable of eliminating or substantially reducing the above mentioned drawbacks related to conventional painting methods.

An object of the present invention is to provide a method which allows to reproduce automatically any desired image on the surface of a manufactured article with high definition and repeatability.

Another object of the present invention is to provide a method which is able to ensure a speed of execution and a qualitative result which allow to introduce it in a fully automated treatment cycle, requiring no manual intervention by specialized personnel.

Another object of the present invention is to provide a method which allows to finish, for example by wood-imitation painting, manufactured articles at a cost which is highly competitive due both to the increase in productivity of the entire system and to the reduction in the costs of specialized labor.

Another object of the present invention is to provide an apparatus which is capable of reproducing automatically any chosen image on the surface of a manufactured article with high definition and repeatability.

Another object of the present invention is to provide an apparatus which allows to reproduce images with great graphic definition and fidelity even on irregular surfaces, i.e., on surfaces having rounded or differently inclined portions.

According to a first aspect of the present invention, a method is provided for finishing a manufactured article by powder painting. The method generally provides for the application, on a surface to be decorated of said manufactured article, of a decorative layer obtained by transfer through controlled migration of powder particles which originate from a graphic matrix arranged in front of the surface to be decorated and designed to adhere thereto, said transfer and said adhesion being provided by way of a first electrostatic field comprising lines of force which are incident at right angles to said surface to be decorated, said manufactured article acting fully or partly as reference electrode for said first electrostatic field, so as to produce a condition of solid contact between said electrode and said surface to be decorated.

Advantageously, the method according to the invention entails arranging the graphic matrix at a preset distance from the surface to be decorated, so as to delimit therewith a gap in which the electrostatic forces of said first electric field are predominant.

A second aspect of the present invention relates to an apparatus comprising at least one graphic matrix. The graphic matrix is provided with a graphic configuration which is equivalent to an image to be transferred onto the face to decorate, and at least one source of an electrostatic field is provided which is suitable to generate, between said graphic matrix and said face to be decorated, an electrostatic force field having lines of force which are incident at right angles to said face to be decorated and are of such intensity as to cause the controlled migration of said particles of powder from said graphic matrix to said face to be decorated in order to obtain on said face to be decorated an image equivalent to said graphic configuration determined by said graphic matrix.

Advantageously, said graphic matrix is arranged, in use, at a preset distance from said surface to be decorated, so as to delimit therewith a gap within which the electrostatic forces of said first electric field are predominant.

BRIEF DESCRIPTION OF THE DRAWINGS

Further characteristics and advantages of the present invention will become better apparent from the following detailed description of some currently preferred embodiments thereof, given merely by way of non-limitative example with reference to the accompanying drawings, wherein.

DESCRIPTION OF THE PREFERRED EMBODIMENTS

Figure 1:
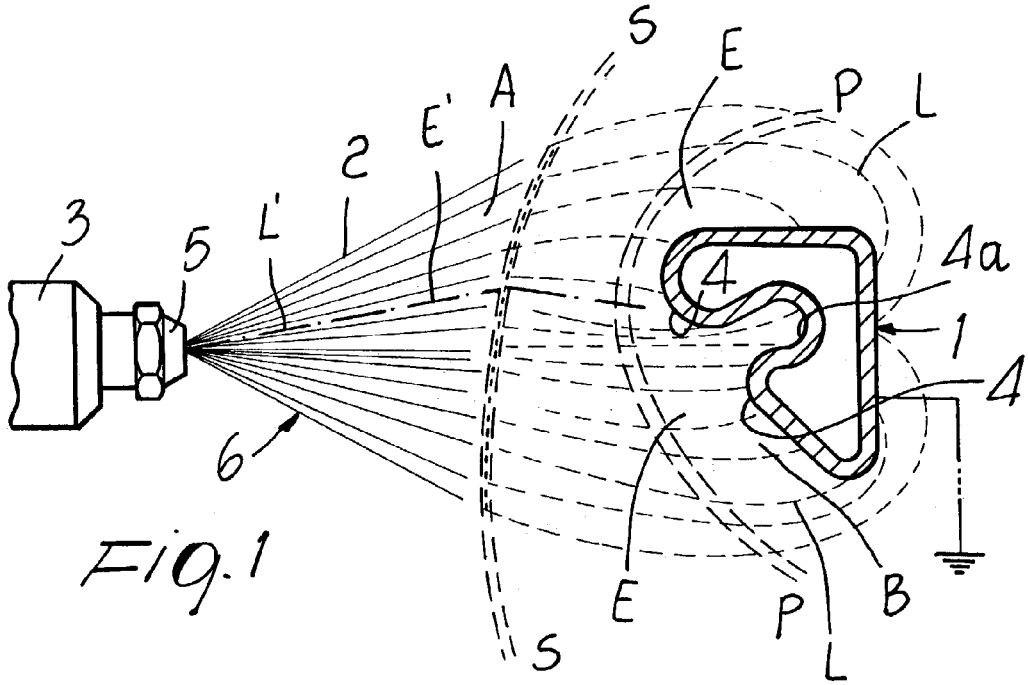
FIG. 1 is a schematic view of the principle on which the finishing process according to the present invention is based.

In the drawings, identical or similar parts or components have been designated by the same reference numerals.

As shown schematically in FIG. 1, the method for finishing a manufactured article 1 by powder painting according to the present invention is based on the controlled transfer of powder particles 2, preferably made of dielectric material, which originate from a source 3 and are designed to adhere to a surface to be decorated 4 of the manufactured article 1 by way of an electrostatic field E having lines of force L which are perpendicular to the surface to be decorated 4.

For the practical realization of the above method, the concurrent existence of some fundamental conditions is preferably required; i.e., the manufactured article 1 must be fully or partially made of electrically conducting material and must be charged electrically during use, so as to act as a reference electrode for the electrostatic field E, and there must be solid contact between said reference electrode, constituted by the manufactured article 1, and the surface to be decorated 4.

In fact, when the manufactured article 1 is entirely made of a conducting material as well as when the conducting material is coated with a surface layer, as long as said layer is permeable to the electrostatic field E, the condition of solid continuity between the surface to be decorated 4 and the reference electrode of the electrostatic field E, which acts at the same time as a target in the painting process, is maintained.

The source 3 which can be constituted by a gun provided with a nozzle 5 designed to be arranged in front of the manufactured article 1, is suitable to dispense, during use, a uniform mixture 6 composed of air and particles of powder 2 toward the manufactured article 1. Advantageously, the gun 3 is charged electrically, so as to generate, in the space in front of it, a second electrostatic field E', which adds up to the electrostatic field E, forming a plurality of lines of force L' which, by virtue of the well-known electrostatic principles, tend to close within the manufactured article 1, at right angles thereto. In practice, the electrostatic fields E and E' can coincide with a single electrostatic field which is designated hereinafter by the reference letter E.

The powder particles 2 expelled by the gun 3 are therefore subjected both to fluid-dynamic and to electrostatic forces in a different ratio as they travel from the gun 3 to the surface to be decorated 4. FIG. 1 in fact shows that one can define two surfaces, designated by s—s and p—p, which respectively delimit, together with the gun 3, a region A, in which fluid-dynamics forces predominate and, together with the surface to be decorated 4, a region B in which the powder particles 2 are affected by the influence of electrostatic forces alone.

On the basis of the above noted remarks, an apparatus 11 is provided which is adapted to perform the finishing of a manufactured article 1 by utilizing the influence of an electrostatic field E and the condition of solid contact between the reference electrode of the electrostatic field, constituted by the manufactured article 1 itself, and the surface to be decorated 4.

Figure 2:
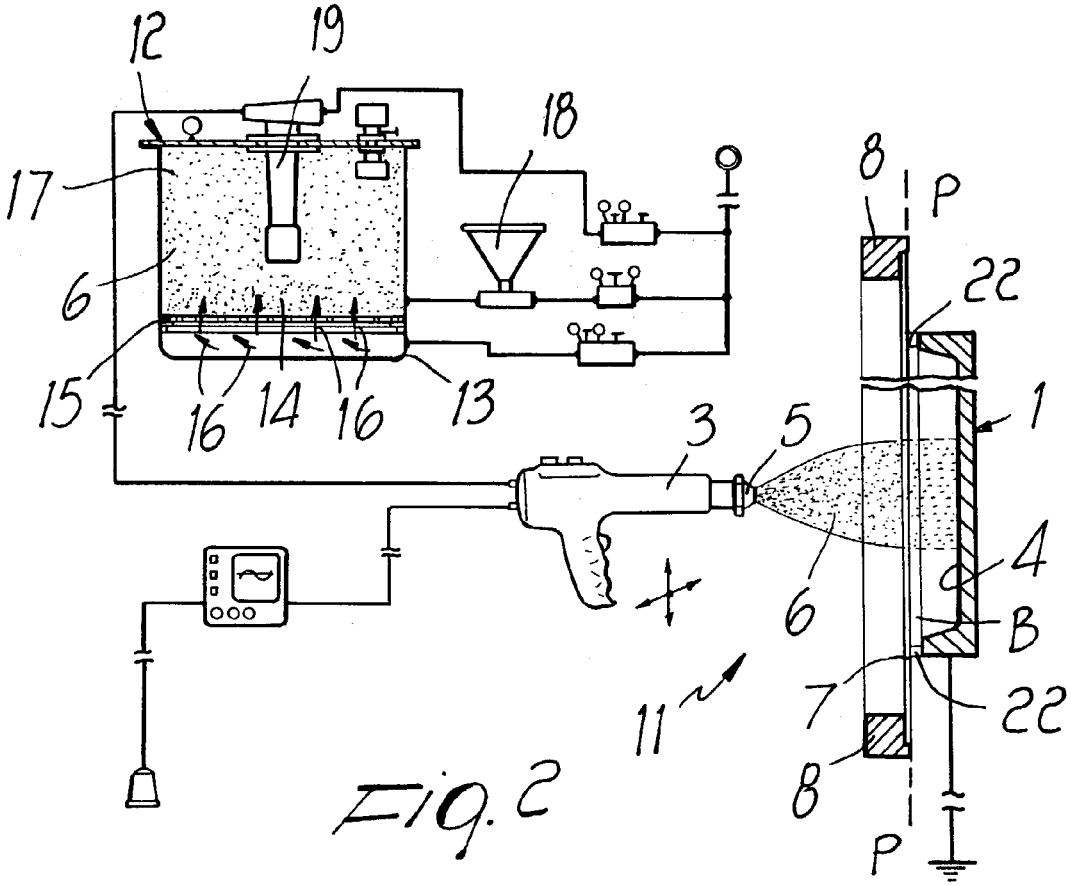
FIG. 2 is a side elevation view of an apparatus adapted to perform the method shown schematically in FIG. 1.
Figure 3:
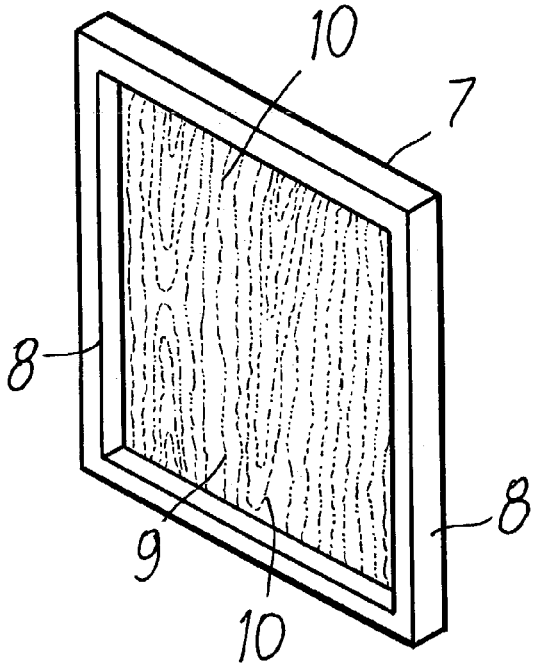
FIG. 3 is a perspective view of a graphic matrix used in the apparatus of FIG. 2.
Figure 4:
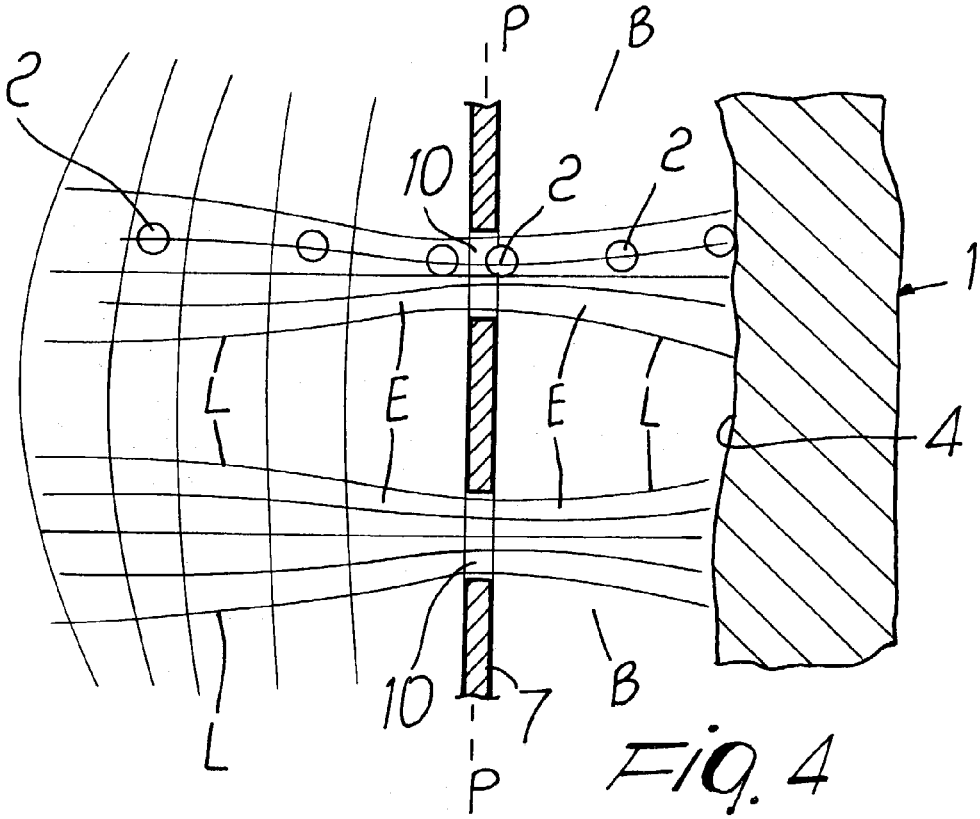
FIG. 4 is an enlarged-scale sectional view of a detail of the graphic matrix of FIG. 3 when, during use, it is crossed by powder particles.

As shown in FIGS. 2 to 4, it is in fact advantageous to arrange, at the surface p—p, i.e., at a preset distance from the surface to be decorated 4, by interposing appropriate spacers 22, a graphic matrix 7 which comprises a frame 8 and a screen 9, preferably made of dielectric material, at which incisions 10 have been formed beforehand according to a graphic configuration being equivalent to the image to be reproduced, such as for example the grain of a type of wood (see FIG. 3).

FIG. 4 shows in particular that the incisions 10 are wider than the size distribution of the powder particles 2, so as to allow them to pass, during use, through the graphic matrix 7 and reach the region B, within which they migrate due to the electrostatic field E alone.

The graphic matrix 7 interposed between the gun 3 and the surface to be decorated 4 therefore acts as a stencil with respect to the air-powder mixture 6 sprayed by the gun 3, allowing said mixture to pass in a controlled amount and in a localized manner toward the region B. The powder particles 2 that pass through the graphic matrix 7 thus find themselves under the influence of the electrostatic field E, which transfers them onto the surface to be decorated 4, forcing each powder particle 2 to follow a path which coincides with a respective line of force L.

By utilizing the electrostatic field E as a means for conveying the powder particles 2, even if the manufactured article 1 has an irregular surface to be decorated 4, such as for example the surface shown in FIG. 1, this would not be a hindrance for reproducing any chosen image thereon, since the electrostatic forces that act along the lines of force L project the powder particles 2 onto the surface to be decorated 4 according to the image formed in the graphic matrix 7, also affecting the regions of the surface to be decorated 4 that otherwise would hardly be reached with current painting methods (such as for example the concave portion 4*a*).

As shown in FIG. 2, the gun 3 is advantageously connected to a system 12 for feeding the air-powder mixture 6, which is designed to form a uniform suspension of powder particles 2 in a fluid medium, such as for example air, generating a fluid bed 14 within an appropriately provided collection reservoir 13. Inside the collection reservoir 13 a porous partition 15 is provided which is designed to be crossed in an upward direction by a stream of pressurized air 16 and to delimit, in an upward region, a chamber 17 inside which the powder particles 2, introduced by a feeder 18, are mixed with the air and then drawn by an aspirator 19 constituted for example by a Venturi tube and are then sent to the gun 3 with a controlled mass flow-rate.

Figure 5:
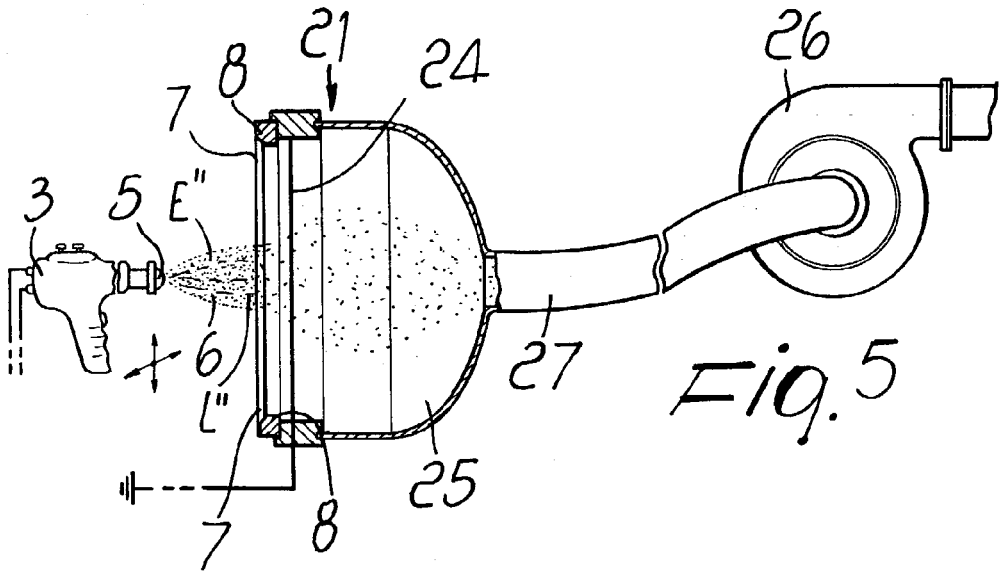
FIG. 5 is a side elevation view of an apparatus for daubing a graphic matrix of the kind shown in FIG. 3.
Figure 6:
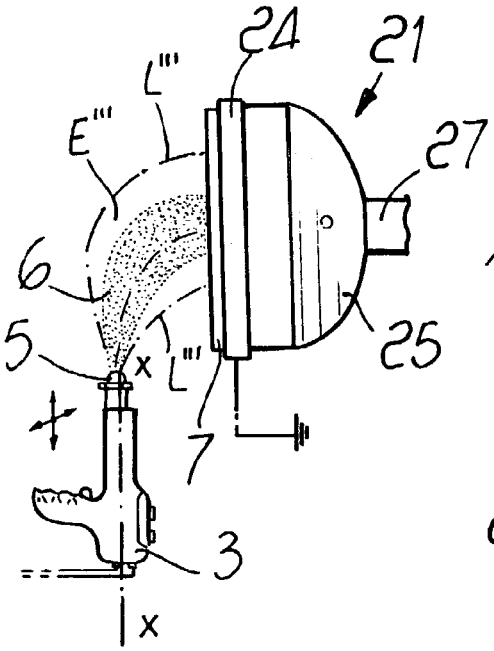
FIG. 6 is a side elevation view of a second embodiment of the apparatus of FIG. 5.
Figure 7:
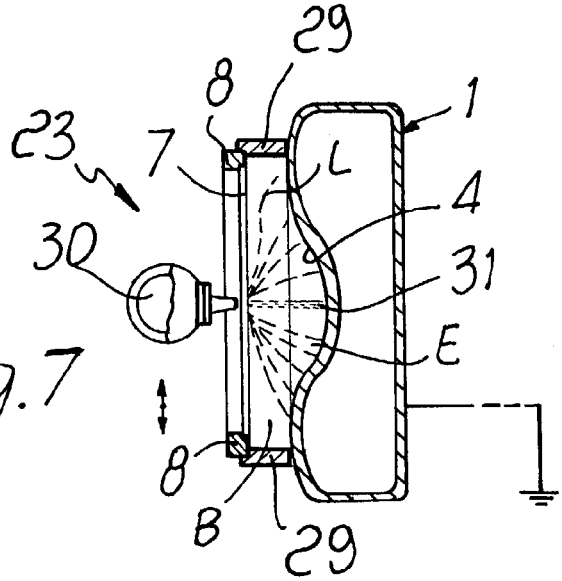
FIG. 7 is a side elevation view of a second embodiment of the apparatus of FIG. 2, adapted to perform the method shown schematically in FIG. 1.

A second embodiment 20 of the above described apparatus 11 is shown in FIGS. 5, 6 and 7 and is preferably composed of a daubing device 21 (see FIGS. 5 and 6) and by a painting unit 23, which are adapted to perform, in two successive steps, respectively the daubing of a graphic matrix 7 and the transfer of the powder particles 2 from the daubed graphic matrix 7 to the surface to be decorated 4 of a manufactured article 1.

The finishing process to be performed by the apparatus 20 uses a graphic matrix 7 which has the same characteristics as the one shown in FIG. 3, except for the fact that its incisions 10 are narrow enough to prevent, during use, the passage of most of the powder particles 2.

Initially, in fact, a gun 3 is arranged in front of a graphic matrix 7 provided with the intended graphic configuration, said gun being adapted to spray an air-powder mixture 6 against it and to generate, in the space in front of said matrix, a third electrostatic field E" as in the previously described situation. Moreover, at the graphic matrix 7 and on the opposite side with respect to the gun 3, there is a base element 24 made of conducting material which is designed, during use, to be connected to the ground so as to allow the lines of force L" of the electrostatic field E" to cross the graphic matrix 7 substantially at right angles. In this case also, the coexistence of fluid-dynamics forces applied by the gun 3 and of electrostatic forces obtained by electrically charging the gun 3 allows to obtain a controlled transfer of the powder particles 2 sprayed by the gun 3 onto the graphic matrix 7. Most of the powder particles 2 in fact migrate through the fluid medium, i.e., the air, until they preferably arrange themselves at the incisions 10, where they are blocked and forced to adhere substantially loosely to the graphic matrix 7.

As shown in FIG. 6, in order to achieve a more precise and targeted distribution of the powder particles 2 on the graphic matrix 7, the gun 3 can be advantageously arranged so as to spray the air-powder mixture 6 in a direction which is substantially parallel to the graphic matrix 7. Since the electrostatic field E'" generated in this case by the electrically charged gun 3 has lines of force L'" which deviate with respect to the initial direction of the air-powder mixture 6 ejected by said gun, the result is the provision of a sort of selection among- the powder particles 2, allowing only the particles that have a preset electric charge to reach the preset regions of the graphic matrix 7, while the others are removed because of the prevalence of the fluid-dynamics forces over the electrostatic ones.

Advantageously, the daubing device 21 further comprises a suction hood 25, which is arranged downstream of the base element 24, on the opposite side with respect to the gun 3, and is connected to a fan 26 by means of a pipe 27 so as to ensure, during use, the recovery of the very fine powder particles 2 that are able to pass through the graphic matrix 7.

Once the operation for daubing the graphic matrix 7 has ended, the graphic matrix is removed from the device 21 and applied, by appropriately provided spacers 29, to the manufactured article 1 with its daubed side facing the face to be decorated 4. At this point the transfer unit 23 is used which comprises a gun 30 adapted to spray a controlled stream of air 31 directed toward the graphic matrix 7 and to generate an electrostatic field E whose lines of force L end in the manufactured article 1 at right angles thereto, said manufactured article being connected to the ground as shown in FIG. 7.

Figure 8:
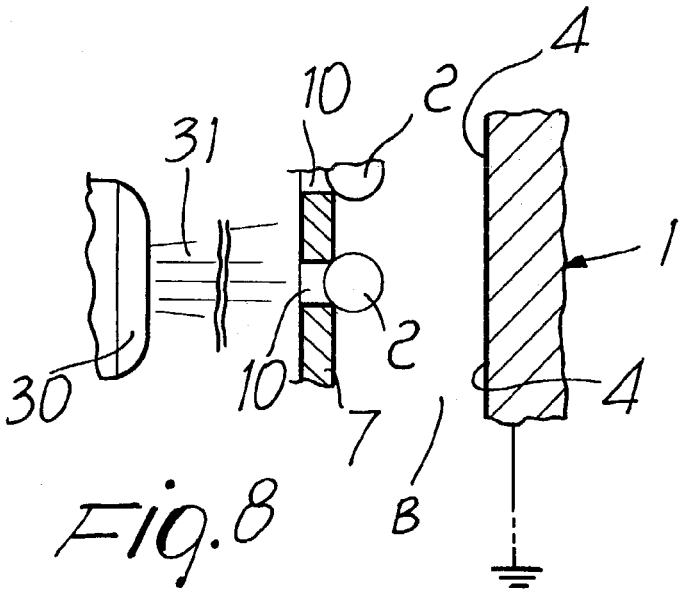
FIG. 8 is an enlarged-scale view of the apparatus of FIG. 7.
Figure 9:
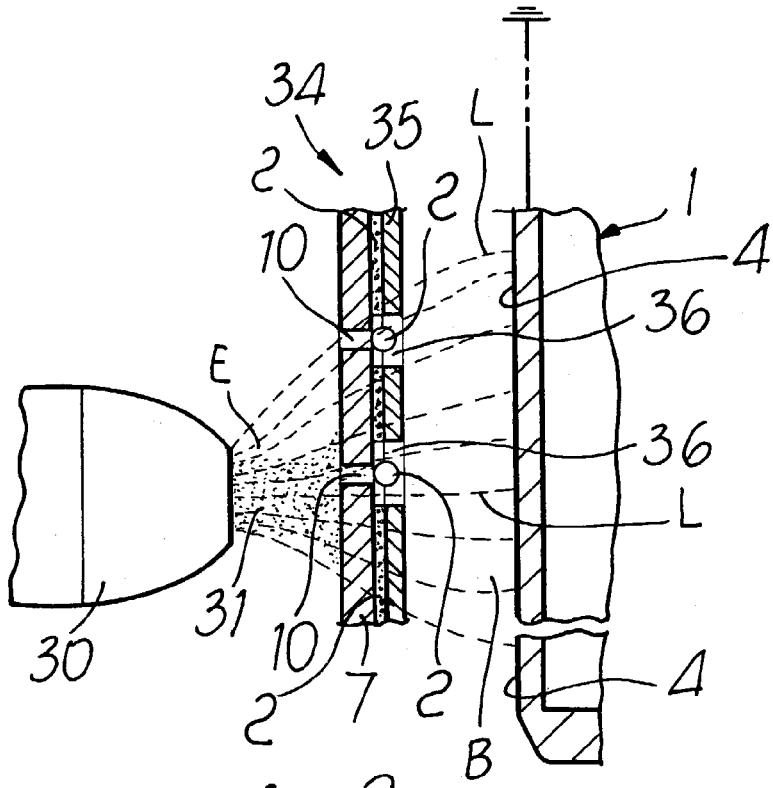
FIG. 9 is a partially sectional side elevation view of another embodiment of the apparatus of FIG. 7.

The air stream 31 generated, in use, by the gun 30 is thus designed to pass through the graphic matrix 7, passing through the incisions 10 so as to separate the powder particles 2 from the graphic matrix 7 and introduce them in the region B, within which the influence of the electrostatic field E is predominant. As shown in particular in FIG. 8, the powder particles 2 are thus forced, by the electrostatic forces that act in the direction of the lines of force L, to transfer from the respective incision 10 of the graphic matrix 7, where they had been applied by means of the daubing process, to a corresponding position on the surface to be decorated 4, so as to project thereon an image which is equivalent to the graphic configuration provided on the graphic matrix 7.

In another configuration 34 of the transfer unit 23, a second graphic matrix 35, whose graphic configuration is equivalent to the one formed on the graphic matrix 7, but with wider incisions 36 than the incisions 10, is superimposed on the daubed graphic matrix 7.

Advantageously, the air stream 31 generated by the gun 30 is thus adapted to penetrate, during use, in the incisions 10 of the graphic matrix 7 and to push against the powder particles 2 that block its exit. When the force applied by the stream 31 overcomes the electrical forces that keep the powder particles 2 stuck to the graphic matrix 7, the powder particles are introduced in the region B by said stream 31 and are directed toward a predefined direction by the incisions 36 of the graphic matrix 35.

Moreover, if it is possible to charge electrically the graphic matrices 7 and 35 with the same sign as the powder particles 2, said particles receive, in addition to the mechanical thrust of the stream 31, also an electrostatic thrust which allows to transfer them onto the surface to be decorated 4 more rapidly and precisely.

Figure 10:
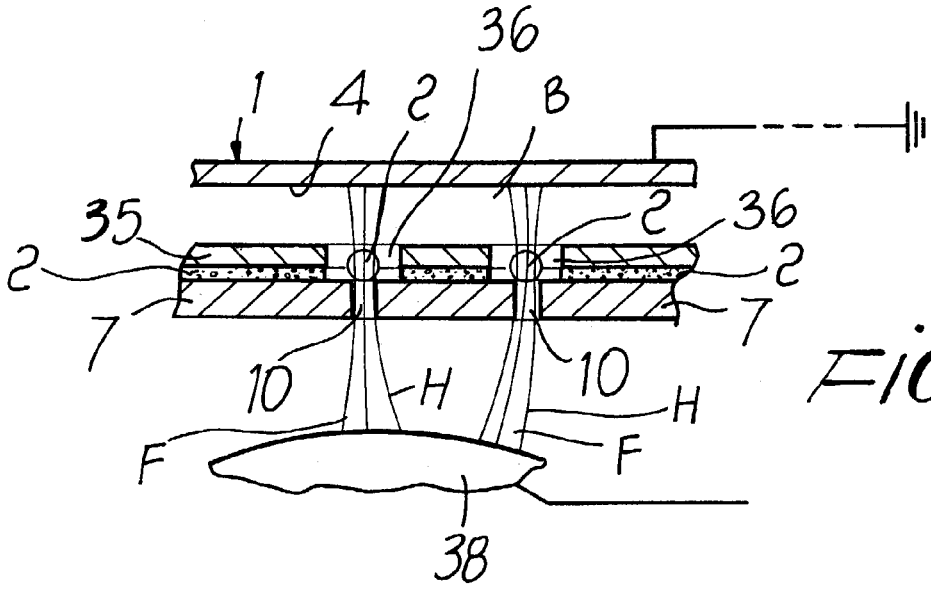
FIG. 10 is a partially sectional side elevation view of another embodiment of the apparatus of FIG. 2, adapted to perform the method shown schematically in FIG. 1.

FIG. 10 illustrates a particular application of the powder painting is method according to the invention, which uses an electrostatic field F instead of the mechanical action of a fluid medium, such as air, as a vehicle for transferring the powder particles 2 from the graphic matrix 7 to the surface to be decorated 4 of a manufactured article 1.

In this case, after placing the daubed graphic matrix 7, coupled to the graphic matrix 35, in front of and at a preset distance from the manufactured article 1, an electrode 38 is placed proximate to the graphic matrix 7 on the opposite side with respect to the manufactured article 1, said electrode having an opposite charge with respect to the powder particles 2 so as to produce an electrostatic field F which is suitable to produce electrostatic forces which act along lines of force H. Since the lines of force H tend to concentrate at the incisions 10 of the graphic matrix 7, in said incisions the electrostatic forces have such an intensity that they remove the powder particles 2 from the graphic matrix 7, making them migrate across the region B until they reach the surface to be decorated 4.

Figure 11:
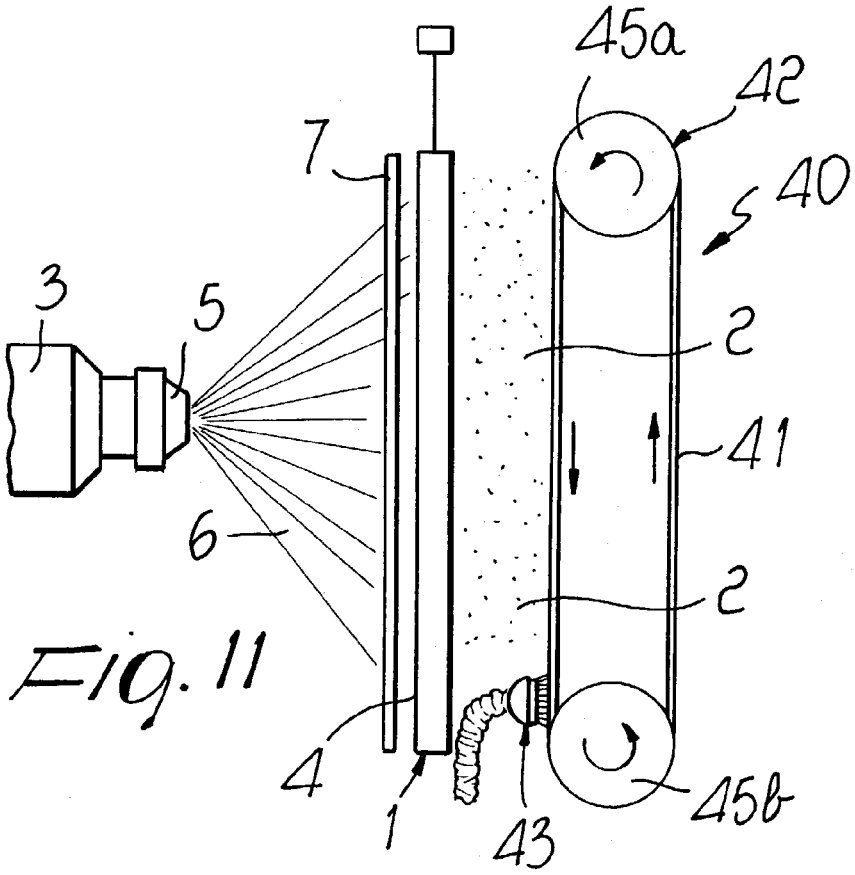
FIG. 11 is a side elevation view of a device for collecting and recovering powder particles, which can be associated with any one of the embodiments of the apparatus of FIG. 2.

In order to reduce the loss into the environment of the powder particles 2 that are not involved in the painting process, downstream of the manufactured article 1 and on the opposite side with respect to a gun 3 for dispensing an air-powder mixture 6, a device 40 is advantageously provided for collecting and recovering the powder particles 2. As shown in FIG. 11, the device 40 can be constituted by one or more fine-mesh filters 41, by a frame 42 for supporting and handling the or each filter 41, and by suction means 43 which are adapted to aspirate the powder particles 2 trapped on the meshes of each filter 41.

The supporting and handling frame 42 preferably comprises two pulleys **45*a* and 45*b*, one of which is a driving pulley, around which the or each filter 41** is wound in order to be turned with a predefined speed.

The suction means 43 are advantageously arranged upstream of the lower pulley 45*b*, so as to clean the or each filter 41 before it makes contact with said pulley. The or each filter 41 thus always affects the stream of powder particles 2 that arrive from the painting apparatuses with clean meshes and is thus able to capture and retain a large amount of powder particles 2.

The powder painting method and the apparatus for performing it as described above are susceptible of numerous modifications and variations, all of which are within the protective scope defined by the content of the appended claims.

Thus, for example, the same results in terms of image resolution and image reproduction on irregular surfaces obtained by means of the above described painting method can also be achieved by placing the graphic matrix 7 in contact with the surface to be decorated 4.

Moreover, by superimposing the graphic matrix 7 on the manufactured article 1 and proceeding as described above, the transfer of the powder particles 2 from the graphic matrix 7 to the surface to be decorated 4 again occurs under the effect of an electrostatic field. In this case, however, instead of causing a physical migration of the powder particles 2 across a gap B, the electrostatic field causes said particles to adhere to the surface to be decorated 4 and to separate from the graphic matrix 7 when said matrix is removed.

For example, before applying the decorative layer, it is also possible to induce on the base layer, a positive ionization performed with any suitable means and/or multiple electrically conducting substances, such as steam, optionally in a controlled atmosphere, in order to increase the electrostatic field between the manufactured article to be decorated and the graphic matrix, said electrostatic field being partially weakened by the presence of the base layer made of insulating material.

In practice, the materials and the dimensions may be various according to requirements.

What is claimed is:

1. A method for finishing a manufactured article by powder painting comprising the steps of:

arranging a graphic matrix provided with a surface which is daubed by powder particles in front of said surface to be decorated of said manufactured article, so that said daubed surface of the matrix is directed toward said surface to be decorated;

keeping said manufactured article at a preset potential, so as to generate between said graphic matrix and said surface to be decorated a first electrostatic field, which has lines of force which are incident at right angles to said surface to be decorated;

arranging an air gun in front of said graphic matrix and on the opposite side with respect to said manufactured article;

actuating said air gun so as to generate a stream of air which is directed toward said graphic matrix and whose thrust is at least sufficient to separate said powder particles from said graphic matrix and make them migrate toward a region where said first electrostatic field is active.

2. The method according to claim 1, comprising keeping said air gun at a predefined electrical potential, so as to generate a second electrostatic field which adds to said first electrostatic field.

3. The method according to claim 2, further comprising before the step of a ranging said graphic matrix in front of said surface to be decorated, the step of the daubing of said graphic matrix with said powder particles, said graphic matrix having said incisions which form a configuration corresponding to the image to be transferred and have a width which retains most of said powder particles.

4. The method according to claim 3, comprising the steps of:

arranging in front of said graphic matrix to be daubed a second gun for dispensing of a controlled mixture of air and powder;

operating said second gun so as to obtain a stream of air and powder which is directed toward said graphic matrix and has a thrust which is at least sufficient to allow said powder particles to reach said graphic matrix and adhere loosely thereto.

5. The method according to claim 4, comprising maintaining said second gun at a preset electric potential, so as to generate a third electrostatic field, which is independent of said first and second electrostatic fields.

6. The method according to claim 5, wherein said second gun sprays said mixture of air and powder in a direction substantially parallel to said graphic matrix, which is subjected to the influence of said third electrostatic field, so that said graphic matrix captures the sprayed powder particles which have a preset electrostatic charge.

7. The method according to claim 6, comprising the step of arranging a conducting element at a preset distance from said graphic matrix and on the opposite side with respect to said second gun, so that said third electrostatic field has lines of force which are substantially perpendicular to said graphic matrix.

8. An apparatus for finishing a manufactured article by powder painting, comprising a daubing device, which is formed by at least one first gun for dispensing a mixture of air and powder particles for daubing a graphic matrix, said gun being adapted to be arranged in front of said graphic matrix to be daubed and an the opposite side with respect to a surface to be decorated, so as to spray, in use, said mixture of air and powder toward said graphic matrix with a thrust which is at least sufficient to make said powder particles reaching said graphic matrix and loosely adhere thereto, said graphic matrix having incisions which form a configuration equivalent to an image to be transferred and the width thereof such as to allows the incisions to retain most of said powder particles.

9. The apparatus according to claim 8, wherein said first gun is kept at a predefined potential, so as to generate a second electrostatic field which combines with a first electrostatic field generated by said dispensing gun and said surface that are charged.

10. The apparatus according to claim 9, wherein said first gun is provided so as to be orientable on a direction substantially parallel to said graphic matrix so as to spray said mixture of air and powder along the same direction, said graphic matrix being subjected to the influence of a third electrostatic field so as to capture the powder particles that have a predefined electrostatic charge.

11. The apparatus according to claim 10, comprising a base element made of conducting material, which is kept at a predefined potential and is arranged at a predefined distance from said graphic matrix on the opposite side with respect to said first gun, so that the lines of force of said electrostatic field intersect said graphic matrix at right angles, said base element being supported by a frame of the graphic matrix.

12. The apparatus according to claim 11, comprising aspirator means provided downstream of said base clement.

13. The apparatus according to claim 12, wherein said aspirator means comprise a hood for collecting said powder particles having a size distribution which allows tern to pass through said graphic matrix, and a fan which is suitable to aspirate said powder particles from said hood.

14. The apparatus according to claim 13, comprising a transfer device which is formed by at least one air dispensing gun adapted to be installed in front of said daubed graphic matrix and suitable to spray, in use, a controlled stream of aft toward the surface of said graphic matrix.

15. The apparatus according to claim 14, wherein said at least one dispensing gun is kept at a predefined electric potential, so as to generate a second electrostatic field which combines with said first electrostatic field.

16. The apparatus according to claim 15, wherein said manufactured article is fully or partly constituted by electrically conducting material, so as to orient the lines of force of said first and second electrostatic fields at right angles to said surface to be decorated.

17. The apparatus according to claim 16, comprising at least one spacer between said manufactured article and said graphic matrix, so as to allow said graphic matrix to be arranged with daubed surface thereof facing said manufactured article at a distance from said manufactured article such as to form a gap corresponding to said first region in which the forces generated by said first and second electrostatic fields predominate over the inertial forces imparted to said powder particles by said air gun.

18. The apparatus according to claim 17, comprising means for collecting and recovering said powder particles, which can be installed at said manufactured article and on the opposite side with respect to said gun for dispensing said mixture of air and powder and are suitable to retain said powder particles which would disperse into the environment.

19. The apparatus according to claim 18, wherein said collection and recovery means comprise at least one mesh filter, a device for supporting and handling the or each filter, and aspirator means which are suitable to aspirate, during use, said powder particles stuck on said meshes of the or each filter.

* * * * *